US007438119B2

(12) United States Patent
Crafton et al.

(10) Patent No.: US 7,438,119 B2
(45) Date of Patent: Oct. 21, 2008

(54) SYSTEM FOR HEAT TREATING CASTINGS AND RECLAIMING SAND

(75) Inventors: Paul M. Crafton, Kennesaw, GA (US); James L. Lewis, Jr., Calabash, NC (US); Ian French, Kennesaw, GA (US); Shanker Subramanian, Marietta, GA (US); James R. Garrett, Acworth, GA (US)

(73) Assignee: Consolidated Engineering Company, Inc., Kennesaw, GA (US)

( * ) Notice: Subject to any disclaimer, the term of this patent is extended or adjusted under 35 U.S.C. 154(b) by 307 days.

(21) Appl. No.: 11/084,321

(22) Filed: Mar. 18, 2005

(65) Prior Publication Data

US 2005/0205228 A1 Sep. 22, 2005

Related U.S. Application Data

(60) Provisional application No. 60/554,502, filed on Mar. 19, 2004.

(51) Int. Cl.
*B22D 29/00* (2006.01)

(52) U.S. Cl. ..... 164/404; 164/5; 266/251; 266/252; 266/257

(58) Field of Classification Search ..... 164/5, 164/131, 132, 404; 266/251, 252, 257
See application file for complete search history.

(56) References Cited

U.S. PATENT DOCUMENTS 4,738,615 A * 4/1988 Bailey et al. ..... 432/15
5,294,094 A 3/1994 Crafton et al.
5,350,160 A 9/1994 Crafton et al.
5,354,038 A 10/1994 Crafton et al.
5,423,370 A * 6/1995 Bonnemasou et al. ..... 164/132
5,531,423 A 7/1996 Crafton et al.
5,551,998 A 9/1996 Crafton et al.
5,565,046 A 10/1996 Crafton et al.
5,738,162 A * 4/1998 Crafton ..... 164/5
5,829,509 A 11/1998 Crafton
5,957,188 A 9/1999 Crafton
6,042,369 A * 3/2000 Bergman et al. ..... 432/15
6,253,830 B1 * 7/2001 Bickford et al. ..... 164/132
6,336,809 B1 1/2002 Crafton et al.
6,547,556 B2 4/2003 Crafton et al.

FOREIGN PATENT DOCUMENTS

GB 2 137 114 A 10/1984
WO WO 02/081127 A2 10/2002

* cited by examiner

*Primary Examiner*—Jonathan Johnson
*Assistant Examiner*—I.-H. Lin
(74) *Attorney, Agent, or Firm*—Womble Carlyle Sandridge & Rice, PLLC

(57) ABSTRACT

A system for reclaiming sand from a casting process includes a chamber having an inlet, an outlet, and a plurality of baffles defining a circuitous path for the sand therebetween, a heating element for providing heat to the chamber, and a fluidizing distributor for directing the sand through the chamber. A method of reclaiming waste sand also is provided.

13 Claims, 4 Drawing Sheets

SYSTEM FOR HEAT TREATING CASTINGS AND RECLAIMING SAND

CROSS-REFERENCE TO RELATED APPLICATION

This application claims priority to U.S. Provisional Application Ser. No. 60/554,502, filed Mar. 19, 2004.

FIELD OF THE INVENTION

The present invention relates generally to the field of foundry processing and, more particularly, to heat treating metal castings and reclaiming sand from sand cores and sand molds used in the manufacture of metal castings.

BACKGROUND OF THE INVENTION

Many changes have been made in the field of heat treating of metal castings and reclaiming sand from sand cores and sand molds used in the manufacture of metal castings. The sand core and/or sand mold (referred to hereafter as "sand core") comprise sand held together by a binder material such as, but not limited to, a combustible organic resin binder. Examples of systems for heat treating castings, removing sand cores, and reclaiming sand are provided in U.S. Pat. Nos. 5,294,094, 5,354,038, 5,423,370, 5,829,509, 6,336,809 and 6,547,556, each of which is expressly incorporated herein by reference in its entirety.

Heat treating, core removal, and sand reclamation technology is driven by, for example, competition, increasing costs of raw materials, energy, labor, and waste disposal, and environmental regulations. Those factors continue to mandate improvements in the field of heat treating and sand reclamation.

SUMMARY OF THE INVENTION

U.S. Provisional Application Ser. No. 60/554,502, filed Mar. 19, 2004, is incorporated by reference herein in its entirety.

Briefly described, the present invention provides a furnace system and method in which waste sand can be refined, cleaned, and otherwise reclaimed, and through which metal workpieces containing sand cores can be directed for heat treatment, core removal, and sand reclamation.

In one aspect, the present invention is directed to a system for reclaiming sand from a casting process, including a chamber having an inlet, an outlet, and a plurality of baffles defining a circuitous path for the sand therebetween. The system further includes a heating element for providing heat to the chamber, and a fluidizing air distributor for agitating the sand and urging the sand through the chamber. The system also may include a fluidizing blower to provide the air flow to the fluidizing air distributor. The system further may include a sand reservoir in flow communication with the inlet of the fluidized bed for storage of the waste sand prior to processing.

In another aspect, the present invention is directed to an integrated core removal and sand reclaiming system. The system includes a core removal unit including at least one chamber though which a casting is moved for removal of a sand core therefrom, a fluidized bed in flow communication with the chamber, and a plurality of baffles defining a circuitous path through the fluidized bed. The fluidized bed is formed at least partially the removed sand core. A radiant heating element may be used to supply heat to the fluidized bed.

Optionally, the core removal unit may comprise a furnace. In this and other aspects, the system also may include an incinerator in flow communication with an exhaust outlet of the furnace. Further, the system may include a heat exchanger in flow communication with the incinerator and the fluidized bed. The heat from the exhaust from the incinerator may be used to at least partially heat the fluidized bed.

In still another aspect of the present invention, a system for processing a metal casting having a sand core therein includes a heat treatment furnace for heat treating the casting and dislodging pieces of the sand core therefrom, and a fluidized sand reclamation chamber in flow communication with the heat treatment furnace, where the fluidized sand reclamation chamber comprises a plurality of baffles defining a circuitous path through which the sand core pieces are directed.

The present invention also contemplates a method of reclaiming waste sand from a casting process. The method includes supplying waste sand to a sand reclamation unit including a chamber having an inlet, an outlet, and a plurality of baffles defining a circuitous path for the waste sand therebetween, wherein the waste sand comprises sand and a binder material, fluidizing the waste sand in a fluidizing medium, and heating the fluidized medium to a binder combustion temperature. As the fluidized waste sand travels from the inlet to the outlet along the circuitous path, the binder material is combusted. The characteristics of the fluidized bed may be selected to achieve the desired level of sand refinement. The fluidizing medium may be heated to a temperature of from about 250° C. to about 900° C. The circuitous path may have a length of from about 5 meters to about 15 meters. The fluidized waste sand travels along the circuitous path for about 30 min. to about 60 min. The waste sand may be supplied to the sand reclamation unit at a rate of from about 10 tons/hr to about 20 tons/hr.

Other aspects of the present invention will become apparent upon reading and understanding this specification, taken in conjunction with the accompanying drawings.

DETAILED DESCRIPTION OF THE INVENTION

The present invention is directed generally to a method and system for reclaiming refined sand from a metal casting process. The method and system of the present invention may be implemented independently, or may be integrated into other metal casting process components, for example, a heat treatment furnace, core removal unit, or the like. According to the present invention, a sand reclamation chamber or unit includes a heated, fluidized bed having a plurality of baffles and/or weirs that define a path through which waste sand travels. As the waste sand travels along the path, the binder is combusted and the sand is refined. The number and length of the baffles, the flow rate through the fluidized bed, the temperature, and other system variables may be specified to attain the desired degree of refinement of the sand.

Figure 1:
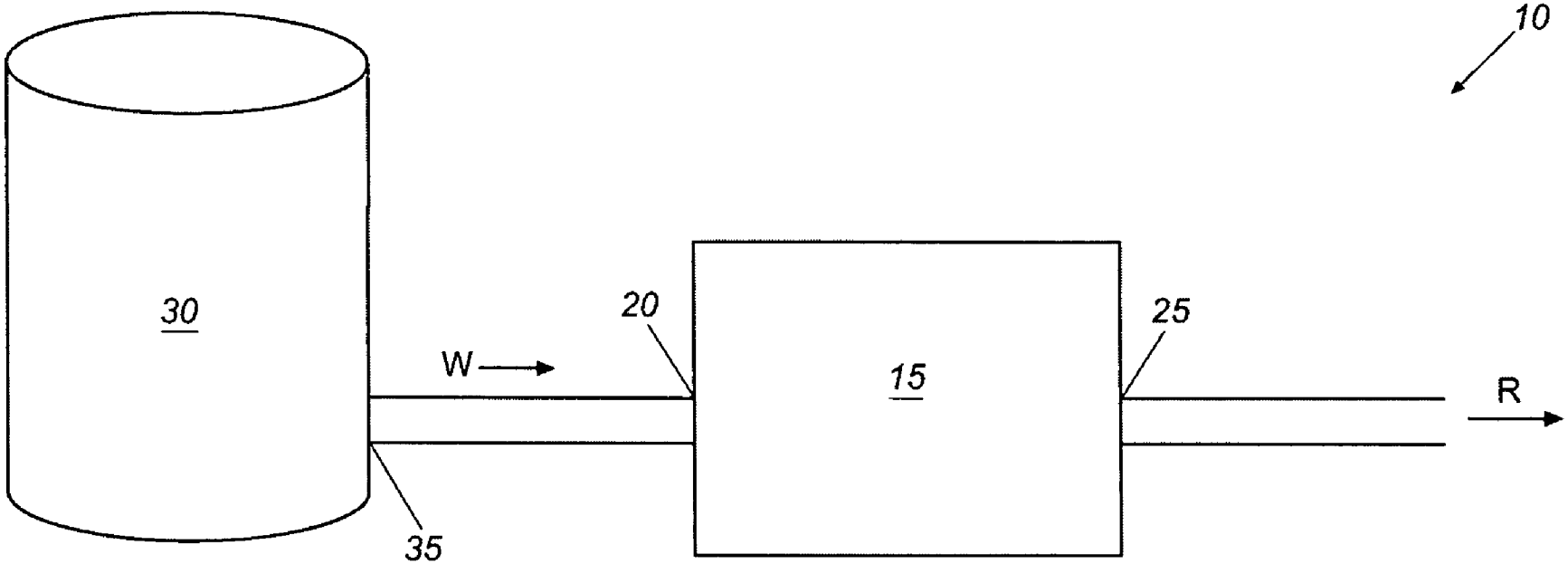
FIG. 1 is a schematic view of an exemplary sand reclamation process according to the present invention.

Referring now to the drawings in which like numerals represent like components throughout the several views, FIG. 1 depicts a system and method for reclaiming sand from a casting process, according to one aspect of the present invention. The system 10 includes a chamber 15 having an inlet 20 and an outlet 25. The waste sand W is provided to the chamber through the inlet. The waste sand may be charged directly from another process unit or step, or may be collected and stored prior to reclamation. For example, the waste sand W may be stored in a sand reservoir 30 designed to receive and store dry, mostly granulated waste sand from the sand system(s) of the facility. The reservoir may have various specifications and features. For example, the waste sand reservoir may be a cylindrical bin about ten feet in diameter with straight sides of about eighteen feet in length, which can store about forty five metric tons of sand. The reservoir may be designed with anti-segregation features (not shown), such as chambers or baffles, that reduce or eliminate separation and discharge of non-uniform sand grain distributions. The reservoir may include a top safety rail, an access hatch, a sand receiver flange, an exhaust flange, an internal safety ladder, roof access, and sand level indicators (not shown). The discharge 35 from the reservoir 30 can include a maintenance slide gate and dual flap valve metering devices (not shown). The waste sand can be metered from the waste sand reservoir at an adjustable rate of, for example, up to about 20 metric tons per hour.

The chamber 15 is provided with a heating element to combust the binder material contained in the waste sand. Any heating element, for example, a radiant heating element, may be used to provide heat to the system. Generally, the temperature of the fluidizing media is maintained at a temperature at or above the combustion temperature of the binder, typically from 250° C. to about 900° C. Thus, in this and other aspects, the temperature of the fluidizing media may be from about 490° C. to about 600° C. As the fluidized waste sand particles move along a circuitous path defined by a plurality of baffles and, optionally, weirs, the binder is combusted and the sand is refined. The circuitous path may have any length as needed or desired to achieve the desired results. For example, in this and other aspects, the path may have a length of from about 5 meters to about 15 meters, for example, about 10 meters. A fluidizing air distributor (not shown) may be used to improve the uniformity of the flow of the fluidizing media. Further, the particles may be urged through the housing using a fluidizing blower (not shown) operated at a flow rate of, for example, about 2300 $Nm^3/h$. The residence time of the waste sand in the chamber is sufficient to substantially refine, clean, and otherwise reclaim the sand before it exits the chamber through an outlet. For example, in this and other aspects, the residence time within the chamber may be from about 30 min. to about 60 min. The substantially refined sand R may be collected or stored in any manner known to those of skill in the art. In this and other aspects, the system may produce from about 10 tons/h to about 20 tons/h, for example, about 15 tons/h of refined sand.

According to another aspect of the present invention, an integrated sand core removal and reclamation system is provided. The system includes a core removal unit including at least one chamber though which a casting is moved for removal of a sand core therefrom. Any method of scoring, breaking, chiseling, shattering, eroding, blasting, or dislodging (collectively "removing") the core may be used as desired. Some exemplary methods of removing a core from a casting are provided in U.S. Pat. Nos. 5,565,046, 5,957,188, and 5,354,038, each of which is incorporated by reference herein in its entirety.

As the core is removed from the casting, the pieces of waste sand are directed by gravity feed or otherwise to a sand reclamation chamber. The sand reclamation chamber includes a fluidized bed in flow communication with the core removal unit and a plurality of baffles defining a circuitous path through the fluidized bed. The fluidized bed is heated to a temperature that is at or above the combustion temperature of the binder. As the sand moves along the circuitous path, the binder is combusted and the sand is refined. The refined sand may be collected and stored in any manner known to those of skill in the art.

Optionally, waste sand from a sand reservoir also may be provided to the reclamation system for concurrent processing with the waste sand generated by core removal.

Figure 2:
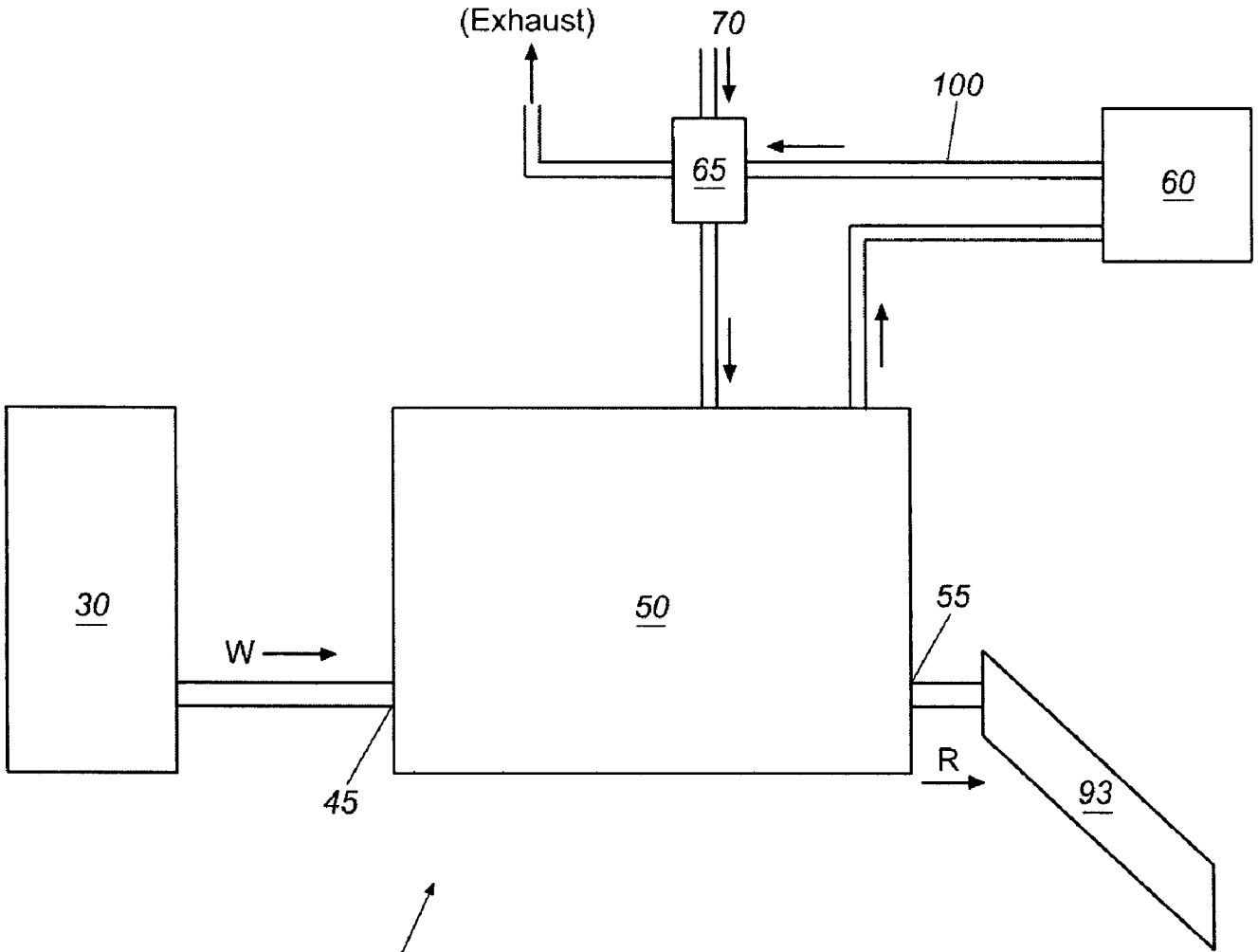
FIG. 2 is a schematic view of an exemplary integrated core removal and sand reclamation system in which the core removal unit comprises a furnace in accordance with the present invention.

FIG. 2 depicts an exemplary integrated core removal and sand reclamation system in which the core removal unit comprises a furnace. The system 40 optionally includes a waste sand reservoir 30 in flow communication through an inlet 45 of a furnace 50. The furnace 50 defines at least one heating chamber through which castings (not shown), such as engine blocks and cylinder heads, are processed for heat treatment, sand core material removal, and sand reclamation. Waste sand W charged into the furnace 50 from the waste sand reservoir 30 can be cleaned, reclaimed, and otherwise refined in the chamber and directed through the outlet 55 for storage or further processing. Additionally, as waste sand is generated from the core removal process, it also may be processed by the sand reclamation system. Alternatively, some or all of the waste sand generated from the core removal process may be collected and stored for later processing.

The system 40 may include an incinerator 60 in flow communication with the chamber of the furnace 50. The system 40 also may include a heat exchanger 65 in flow communication with the incinerator 60, a source of fluidized air 70, and the chamber of the furnace 50. Heat from the incinerator 60 may be used to heat the fluidizing air and/or heat the interior of the chamber of the furnace 50.

Figure 3:
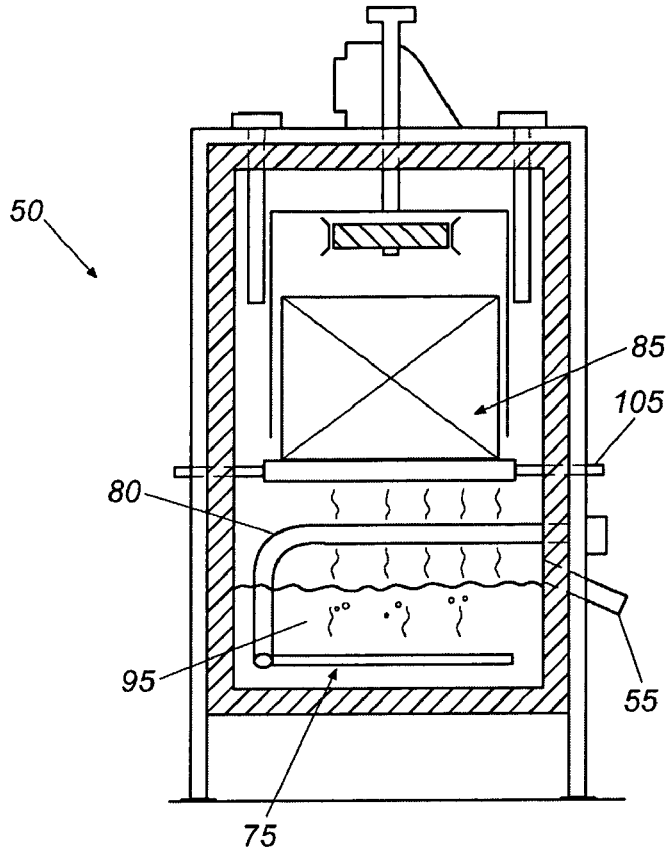
FIG. 3 is a cross sectional view of the furnace shown in FIG. 2.
Figure 4:
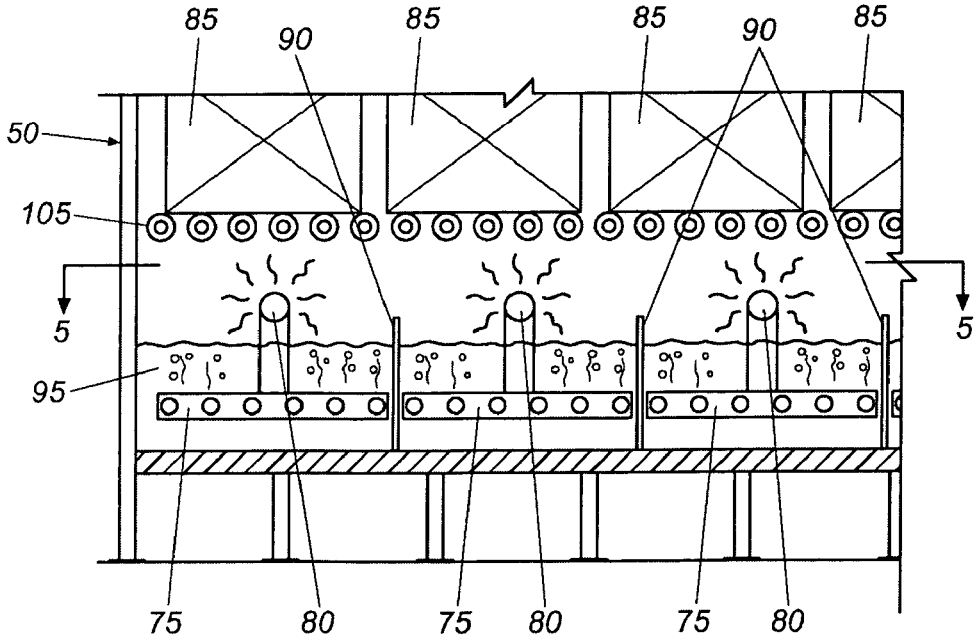
FIG. 4 is another cross-sectional view of a portion of the furnace shown in FIG. 2.
Figure 5:
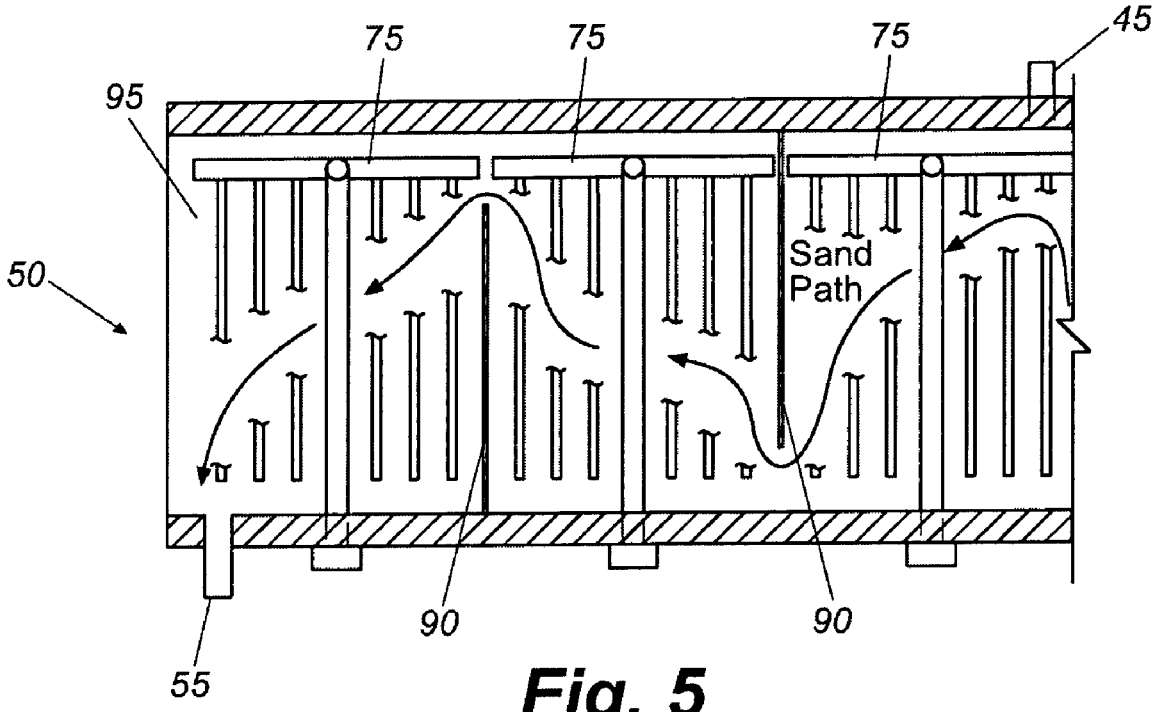
FIG. 5 is a cross-sectional view of the furnace in FIG. 4 taken along line 5-5.

Turning to FIGS. 3-5, the furnace 50 may include a complement of fluidizing air distributors 75 and/or heating elements, for example, radiant tube heaters 80, located below a roller hearth 105 on which castings 85 are transported through the furnace 50. One or more weirs and baffles 90 are disposed in the lower section of the furnace 50 within the area of the fluidized bed 95. The baffles 90 define a circuitous path through which waste sand must travel to exit through sand outlet 55. The residence time of the waste sand in the furnace 50 is sufficient to refine, clean, and otherwise reclaim the same before it exits the furnace 50. In one aspect, the furnace 50 is a Number One or Number Two Sand Lion® lower furnace module available from Consolidated Engineering Corporation of Kennesaw, Ga. However, it should be understood that any other suitable furnace may be used in accordance with the present invention.

The fluidizing heating system provided in the furnace 50 includes one or more heating elements 80, which are shown as radiant heating tubes in FIGS. 3-5. The heating elements 80 supplement addition of heat into the furnace 50 heating zones, and compensate at least partially for heat lost during opening of the furnace door and addition of cooler castings 85. The fluidizing heating system may also provide radiant heating directly to the lower level of castings 85. Generally, the fluidizing temperature can be the same as the furnace heating temperature. The fluidizing system also can include a fluidizing blower (not shown) to provide pressurized air to the fluidizing distributors 75.

The furnace exhaust air incinerator 60 (FIG. 2) may be any suitable incinerator, as will be appreciated readily by those of skill in the art. For example, the incinerator may be operated at up to about 825° C. for about a 1.0-second resident time to burn carbon monoxide and volatile organic compounds to an acceptable level for discharge to the atmosphere. In one aspect, the incinerator 60 has a capacity of about 6800 $Nm^3H$. In another aspect, the incinerator 60 includes sidewall insulation of about 200 mm thick 1260° ceramic fiber. In other aspects, the incinerator 60 includes a top-mounted burner with gas train and controls, an inspection door, or both, and other features known to those of skill in the art. Inner mixing baffles, an inlet profiling plate, or a combination there of may be used to attain sufficient velocity and turbulence in the incinerator.

Likewise, the heat exchanger 65 may be any suitable heat exchanger, as will be understood readily by those of skill in the art. The heat exchanger 65 may use heat from the incinerator 60 to at least partially heat the air to be used in the fluidizing system. Hot dirty gases generally enter the heat exchanger 65 from the incinerator connecting duct 100 and exit via an exhaust duct. In one aspect, the heat exchanger 65 is a U-tube type exchanger having overall dimensions of about 4000 mm by 2100 mm by 2100 mm high. In another aspect, the outer casing of the heat exchanger is steel plate with structural steel support, as well as other suitable materials. In another aspect, the insulation of the heat exchanger is castable MC25 backed with 75 mm mineral wool, and the roof insulation is ceramic fiber modules. In yet another aspect, the front rows of heat exchanger tubing are formed from Incoloy 800 HT, and the remaining rows SA-249-304L are formed from stainless steel. The tubing may be 35 mm OD with 2.1 mm average wall thickness. Process air tube bundle top manifolds may be a combination of 6 mm thick 304 stainless steel and carbon steel.

Reclaimed sand R is discharged from the outlet 55 to a hot sand inclined conveyor 93. The system 40 may produce from about 3 to about 10 tons/h, for example, about 5 tons/h, of sand from sand core material removed from castings processed in the furnace 50 and from about 5 to about 15, for example, about 10 tons/h, of waste sand from the reservoir 30, thereby having an overall production rate of from about 10 to about 20 tons/h, for example, about 15 tons/h, of refined sand.

The reclaimed sand can be combined with other sand in downstream process units in which the sand is pre-screened, final screened, and cooled. The various post-reclamation steps may have a total production capacity of from about 10 to about 20 tons/h, for example, 15 hours.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

While the present invention is described herein in detail in relation to specific aspects, it is to be understood that this detailed description is only illustrative and exemplary of the present invention and is made merely for purposes of providing a full and enabling disclosure of the present invention. The detailed description set forth herein is not intended nor is to be construed to limit the present invention or otherwise to exclude any such other embodiments, adaptations, variations, modifications, and equivalent arrangements of the present invention, the present invention being limited solely by the claims appended hereto and the equivalents thereof.

What is claimed is:

1. An integrated system for removing and reclaiming sand from a casting process, comprising:

a furnace including a heating chamber having an upper section through which castings are moved and a lower section below a path of travel for the castings, said heating chamber having an inlet, an outlet, and a plurality of baffles arranged along said lower section and defining a circuitous path for the sand therebetween;

a heating element for providing heat to said lower section; and at least one fluidizing air distributor for supplying fluidizing air into said lower section for urging the sand through said lower section and along said circuitous path for the sand.

2. The system of claim 1, further comprising a fluidizing blower.

3. The system of claim 1, further comprising a sand reservoir in flow communication with said inlet of said lower section.

4. A system for reclaiming sand from a casting process, comprising:

a core removal unit including at least one chamber though which a casting is moved for removal of a sand core therefrom;

a fluidized bed in flow communication with said chamber, said fluidized bed being formed at least partially from the removed sand core; and a plurality of baffles defining a circuitous path through said fluidized bed; and at least one fluidizing air distributor for supplying fluidizing air to sand moving along said circuitous path through said fluidized bed.

5. The system of claim 4, further comprising a radiant heating element for supplying heat to said fluidized bed.

6. The system of claim 4, wherein the core removal unit comprises a furnace.

7. The system of claim 6, further comprising an incinerator in flow communication with an exhaust outlet of said furnace.

8. The system of claim 7, further comprising a heat exchanger in flow communication with said incinerator and said fluidized bed.

9. The system of claim 8, wherein heat from said incinerator is used to at least partially heat said fluidized bed.

10. A system for processing metal castings and reclaiming sand from sand cores of the castings, comprising:

a heat treatment furnace for heat treating the castings and dislodging portions of the sand cores therefrom;

a roller hearth for transporting the castings through said heat treatment furnace;

a fluidized bed positioned within and extending through said heat treatment furnace beneath said roller hearth for receiving the portions of the sand cores dislodged from the castings and having a series of baffles mounted therein and defining a circuitous path along which the portions of the sand cores are moved for reclaiming the sand therefrom;

a heating element; and at least one fluidizing air distributor for supplying fluidizing air to the sand within said fluidized bed to urge the sand along said circuitous path through said heat treatment furnace.

11. The system of claim 10, further comprising an incinerator in flow communication with an exhaust outlet of said heat treatment furnace.

12. The system of claim 11, further comprising a heat exchanger in flow communication with sand incinerator and said fluidizing sand reclamation chamber.

13. The system of claim 12, wherein heat from said incinerator is used to at least partially heat said fluidizing sand reclamation chamber.

* * * * *